US007118014B2

(12) United States Patent
Ali et al.

(10) Patent No.: US 7,118,014 B2
(45) Date of Patent: Oct. 10, 2006

(54) STRONG GARMENT HANGER

(75) Inventors: Hamid Syed Ali, 24502 Kings View, Laguna Niguel, CA (US) 92677; Diner Mondragon, Cudahy, CA (US)

(73) Assignee: Hamid Syed Ali, Laguna Niguel, CA (US)

( * ) Notice: Subject to any disclaimer, the term of this patent is extended or adjusted under 35 U.S.C. 154(b) by 280 days.

(21) Appl. No.: 10/860,766

(22) Filed: Jun. 3, 2004

(65) Prior Publication Data

US 2005/0269377 A1 Dec. 8, 2005

(51) Int. Cl.
*A41D 27/22* (2006.01)

(52) U.S. Cl. ..... 223/85

(58) Field of Classification Search ..... 223/85, 223/88, 92, 95, 97
See application file for complete search history.

(56) References Cited

U.S. PATENT DOCUMENTS

| | | | | | |
|---|---|---|---|---|---|
| 2,665,828 | A * | 1/1954 | Dorothy | 223/92 |
| 3,059,824 | A * | 10/1962 | Henry | 223/88 |
| 3,168,970 | A * | 2/1965 | Wilson | 223/92 |
| 3,451,601 | A * | 6/1969 | Ioviero et al. | 223/85 |
| 3,459,349 | A * | 8/1969 | Batts | 223/91 |
| 3,467,291 | A * | 9/1969 | Phillips et al. | 223/85 |
| 3,679,100 | A * | 7/1972 | Brorson et al. | 223/88 |
| 3,860,153 | A * | 1/1975 | Davis, Jr. | 223/88 |
| 3,870,206 | A * | 3/1975 | Feinberg | 223/88 |
| 4,586,637 | A * | 5/1986 | Lemel | 223/92 |
| 4,813,581 | A * | 3/1989 | LaMont | 223/94 |
| 4,951,855 | A * | 8/1990 | Jacobson et al. | 223/88 |
| 5,056,248 | A * | 10/1991 | Blanchard | 40/322 |
| 5,056,693 | A * | 10/1991 | DeBoe | 223/88 |
| 5,137,191 | A * | 8/1992 | Blanchard et al. | 223/88 |
| 5,277,345 | A * | 1/1994 | Ozaki | 223/98 |
| 5,613,627 | A * | 3/1997 | Marks | 223/85 |
| 5,680,972 | A * | 10/1997 | Clarke | 223/88 |
| 5,758,806 | A * | 6/1998 | Anderson | 223/92 |
| 5,868,289 | A * | 2/1999 | Lee | 223/87 |
| 2004/0069819 | A1* | 4/2004 | Strouts | 223/85 |
| 2004/0159686 | A1* | 8/2004 | Huang | 223/85 |
| 2004/0256425 | A1* | 12/2004 | Barre et al. | 223/85 |

* cited by examiner

*Primary Examiner*—Gary L. Welch
(74) *Attorney, Agent, or Firm*—John L. Rogitz

(57) ABSTRACT

A strong but lightweight garment hanger includes a unitary body that can be made of Aluminum or plastic. A hook support member depends down from the hook of the hanger, and first and second arm members extend down from the hook support member. For strength, each arm member includes an inner arm and an outer arm connected to the inner arm by connector segments. A lower support member extends between the arm members and includes upper and lower elements and a strengthening web between the lower and upper elements.

22 Claims, 2 Drawing Sheets

STRONG GARMENT HANGER

I. FIELD OF THE INVENTION

The present invention relates generally to garment hangers.

II. BACKGROUND OF THE INVENTION

Garment hangers typically cannot easily hold an ensemble but rather usually can support only a single coat or but a few items of an ensemble. This is because most garment hangers are intended to hold only a single garment. For example, the ubiquitous wire hanger cannot easily hold more than one garment and in some cases can leave a crease in the shoulder of a lighter garment such as a shirt. Also, most hangers do not securely hold many common items of an ensemble, such as a man's tie or a woman's scarf. When carrying such items on a hanger a person consequently must keep an eye on them to ensure they do not fall off.

As recognized by the present invention, this causes people who might wish to carry an entire clothing ensemble on a hanger to, e.g., the gymnasium or other location at which they intend to change clothes to resort to using several hangers. This is cumbersome. Further, many ensemble items may require separate baggage altogether particularly if the mode of transportation used to arrive at the destination causes insecurely hung items such as ties to slip off the hanger. Nonetheless, conveying clothing on a hanger is often preferable to folding the clothing into luggage because hung clothing does not wrinkle. Having made these critical observations, the invention herein is provided.

SUMMARY OF THE INVENTION

A sturdy garment hanger is defined by a unitary body that includes a hook, a hook support member depending downwardly from the hook, and first and second arm members extending downwardly away from the hook support member. Each arm member includes an inner arm and an outer arm connected to the inner arm by at least one connector, with the outer arm of each arm member forming at least one strap retaining clip. Also, a lower support member extends between the arm members and connects them. The lower support member includes an elongated lower element, an elongated upper element, and at least one connector such as a strengthening web between the lower and upper elements. The arms and upper and lower elements may have flat faces.

In non-limiting embodiments the hook support member may have three edges defining an enclosure and a hook support web filling the enclosure. The edges of the hook support member can define a first thickness and the hook support web defines a second thickness that is less than the first thickness. Likewise, the elements of the lower support member define a first thickness and the strengthening web defines a second thickness that may be less than the first thickness.

In one embodiment the body is made of Aluminum, and the outer arm of each arm member forms at least two strap retaining clips. In this embodiment the body can further include a cross bar extending between the arm members below the hook support member, with an auxiliary enclosure being formed above the cross bar. Also, the arm members join each other below the hook support member to define an arm junction, and the arm junction defines an enclosure and plural strengthening struts each extending across the enclosure. Garment retainers with tacky surfaces can be engaged in an interference fit with each arm member and with the lower support member to uncreasingly support a shirt at its shoulders or pants that are folded over the lower support member.

In another aspect, a garment hanger has a hook connected to a hook support member and two arm members extending down from the hook support member. Each arm member has double arm construction. The arm members join the hook support member and are connected to each other by a lower support member having double arm construction.

In still another aspect, a hanger with a hook and a generally triangular-shaped body has a double arm configuration in each of three sides and at least one web in at least one side for strength.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
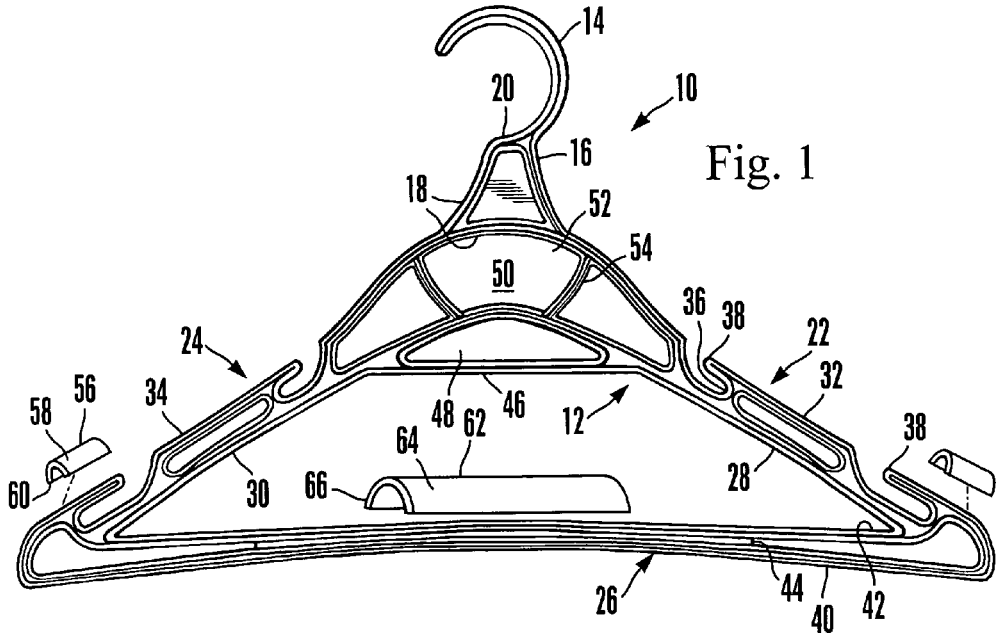
FIG. 1 is a side view of a first embodiment of the garment hanger, showing the garment retainers in an exploded relationship with the hanger.

Referring initially to FIG. 1, a garment hanger is shown, generally designated 10, that is established by a unitary body 12. In the first embodiment shown in FIG. 1, the body 12 is made of Aluminum, so that it is not only strong but rigid. The weight of the body 12 may be around two hundred fifteen grams, i.e., the hanger 10 is lightweight. The body 12 may be made by injection molding or other method of manufacture.

As shown in FIG. 1, the body 12 is formed with a hook 14 that is sized and configured for engaging a rod or bar or other support. A hook support member 16 is connected to the hook 14. The non-limiting hook support member 16 is solid in that it has three edges 18 defining an enclosure therebetween and a hook support web 20 filling the enclosure. The hook support web 20 is flat and it is thinner than the edges 18 of the hook support member 16.

The main portion of the hanger 10 is generally shaped like an equilateral triangle and is established by two elongated arm members 22, 24 that are connected to and extend down from the hook support member 16 to essentially establish the arms of the triangle and by an elongated lower support member 26 extending between the arm members 22, 24 and connecting the arm members 22, 24 to essentially establish the base of the triangle. The members 22, 24, 26 can have double arm construction. Specifically, each arm member 22, 24 can include a respective inner arm 28, 30 and a respective outer arm 32, 34 connected to the associated inner arm 28, 30. In one embodiment the arms are connected by at least one and preferably plural connector segments 36. Or, a web can be used.

Also, the outer arm 32, 34 of each arm member 22, 24 can form preferably two strap retaining clips 38, so that more than one garment having shoulder straps can be conveniently supported on the hanger 10. In essence, each strap retaining clip 38 is established by a discontinuity in the outer arm 32, 34 in combination with a respective connector segment 36 and the continuous inner arm 28, 30 as shown. Thus, the inner arms 28, 30 are continuous throughout their lengths but the outer arms 32, 34 can have discontinuities to establish the strap retaining clips 38.

The lower support member 26 also may have double arm construction. Specifically, the lower support member 26 can include an elongated lower element 40 and an elongated upper element 42. In the embodiment shown in FIG. 1, a strengthening web 44 extends between the lower and upper elements 40, 42 for most of their lengths. The strengthening web 44 can be thinner than the elements 40, 42 of the lower support member 26. Or, connector segments can be used.

FIG. 1 shows that the inner arm 28, 30 of each arm member 22, 24 is contiguous to the upper element 42 of the lower support member 26. Also, the outer arm 32, 34 of each arm member 22, 24 is contiguous to the lower element 40 of the lower support member 26. If desired, the arms 28–34 of the arm members 22, 24 and the upper and lower elements 40, 42 of the lower support element 26 can have flat faces.

In addition to the above-described structure, the body 12 may include a cross bar 46 extending between the arm members 22, 24 below the hook support member 16. An auxiliary enclosure 48 is thus formed above the cross bar 46. A scarf or other small garment can be partially placed through the enclosure 48 and supported with other garments on the hanger 10.

As shown in FIG. 1, the arm members 22, 24 join each other below the hook support member 16 to define an arm junction 50. The arm junction 50 essentially defines an enclosure 52, and two strengthening struts 54 extend across the enclosure 52 to further strengthen the hanger 10. A small garment can be placed partially through the enclosure 52.

Figure 3:
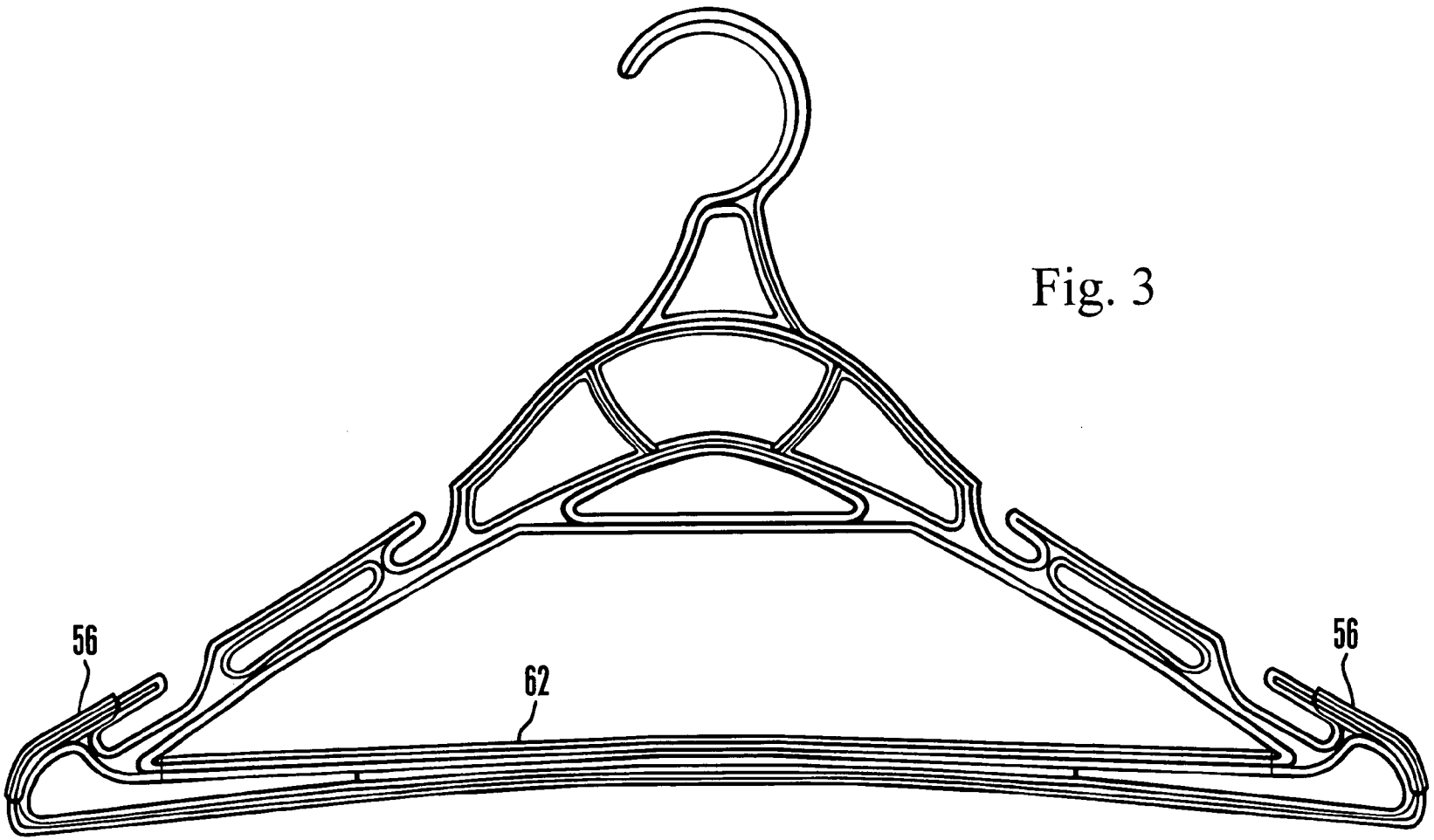
FIG. 3 is a side view of the first embodiment showing the garment retainers engaged with the hanger.

Completing the description of FIG. 1 and cross-referencing FIG. 3, if desired a respective arm garment retainer 56 can be engaged in an interference fit with the outer arm 32, 34 each arm member 22, 24 to uncreasingly support a shirt at its shoulders. Each arm garment retainer 56 has a tacky rounded surface 58 and a channel 60, with the channel 60 snugly receiving the respective outer arm 32, 34 to hold the retainer 56 onto the arm member. Likewise, a lower garment retainer 62 can be engaged in an interference fit with the upper element 42 of the web 44. The lower garment retainer 62 has a tacky rounded surface 64 to uncreasingly support pants folded over it, and a channel 66 snugly receiving the upper element 42. The retainers 56, 62 can be made of plastic or rubber.

Figure 2:
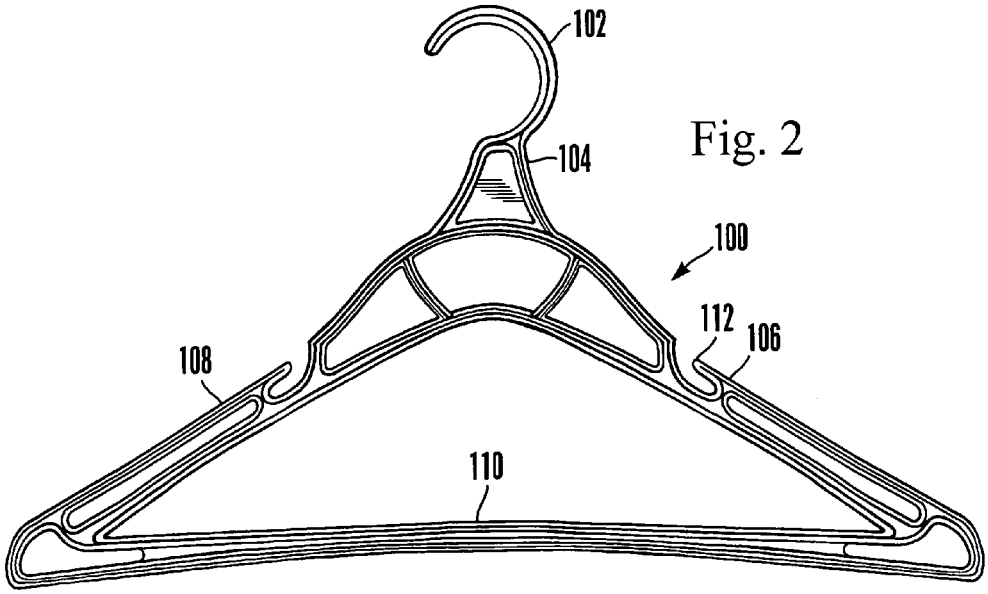
FIG. 2 is a side view of a second embodiment of the garment hanger.

FIG. 2 shows a second embodiment in which a hanger 100 is made of a unitary piece of plastic that can be formed by, e.g., injection molding. The hanger 100 has a hook 102 and a hook support member 104 that are substantially identically configured to the hook 14 and hook support member 16 shown in FIG. 1. Also, the hanger 100 has arm members 106, 108 and a lower support member 110 that are substantially identically configured to the members 22, 24, 26 shown in FIG. 1, except that the arm members 106, 108 shown in FIG. 2 have only a single respective strap retaining clip 112, and no crossbar between the arm members 106, 108 need be provided. Garment retainers like the ones shown in FIG. 1 can also be used with the hanger 100 shown in FIG. 2.

While the particular STRONG GARMENT HANGER as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". It is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. Absent express definitions herein, claim terms are to be given all ordinary and accustomed meanings that are not irreconcilable with the present specification and file history.

What is claimed is:

1. A sturdy garment hanger defined by a unitary body comprising:

a hook;

a hook support member depending downwardly from the hook;

first and second arm members extending downwardly away from the hook support member, each arm member including at least an inner arm and an outer arm connected to the inner arm by at least one connector, the arms of each arm member defining an open space between at least a portion of the arms, the outer arm of each arm member forming at least one strap retaining clip; and a lower support member extending between the arm members and connecting the arm members, the lower support member including at least one elongated lower element, at least one elongated upper element, and at least one connector between the lower and upper elements, the outer arms of each arm member joining each other in an arc to define a bottom edge of the hook support member, the inner arms joining each other in an arc below the arc of the upper arms, an open space being established between the arcs.

2. The hanger of claim 1, wherein the connector between the elements of the lower support member is a strengthening web, and the connectors between the arms of the arm members are connector segments.

3. The hanger of claim 2, wherein the elements of the lower support member define a first thickness and the strengthening web defines a second thickness less than the first thickness.

4. The hanger of claim 1, wherein the hook support member has plural edges defining an enclosure therebetween and a hook support web filling the enclosure.

5. The hanger of claim 4, wherein the edges of the hook support member define a first thickness and the hook support web defines a second thickness less than the first thickness.

6. The hanger of claim 1, wherein the body is made of Aluminum, and the outer arm of each arm member forms at least two strap retaining clips.

7. The hanger of claim 1, wherein the body is made of Aluminum, and the body further comprises a cross bar extending between the arm members below the hook support member, an auxiliary enclosure being formed above the cross bar.

8. The hanger of claim 1, wherein the arm members join each other below the hook support member to define an arm junction, the arm junction defining an enclosure and plural strengthening struts each extending across the enclosure.

9. The hanger of claim 1, wherein the inner arm of each arm member is contiguous to the upper element of the lower support member and the outer arm of each arm member is contiguous to the lower element of the lower support member.

10. The hanger of claim 1, wherein the arms of the arm members and the upper and lower elements of the lower support element have flat faces.

11. The hanger of claim 1, further comprising a respective garment retainer engaged in an interference fit with each arm member, each garment retainer having a tacky rounded surface to uncreasingly support a shirt at the shoulders thereof.

12. The hanger of claim 1, further comprising a garment retainer engaged in an interference fit with the lower support member, the garment retainer having a tacky rounded surface to uncreasingly support pants folded thereover.

13. A garment hanger having a hook connected to a hook support member and two arm members extending down from the hook support member, each arm member having double arm construction, the arm members joining the hook support member, the arm members being connected to each other by a lower support member having double arm construction, wherein the hook support member defines at least three edges defining an enclosure;

a cross bar extends between the arm members below the hook support member, an auxiliary enclosure being formed above the cross bar;

the arm members join each other below the hook support member to define an arm junction located above the auxiliary enclosure and below the hook support member, the arm junction defining an enclosure and plural arcuate strengthening struts each extending downwardly, a first strut being contiguous to a first one of the arm members and a second strut being contiguous to a second one of the arm members.

14. The hanger of claim 13, wherein the hanger is established by a unitary structure.

15. The hanger of claim 13, wherein each arm member includes an inner arm and an outer arm connected to the inner arm by at least one connector segment, the outer arm of each arm member forming at least one strap retaining clip.

16. The hanger of claim 13, wherein the lower support member includes a lower element and an upper element and a strengthening web between the lower and upper elements.

17. The hanger of claim 16, wherein the elements of the lower support member define a first thickness and the strengthening web defines a second thickness less than the first thickness.

18. The hanger of claim 13, wherein the hook support member has plural edges defining an enclosure therebetween and a hook support web filling the enclosure, the edges of the hook support member defining a first thickness and the hook support web defining a second thickness less than the first thickness.

19. The hanger of claim 13, wherein the structure is made of Aluminum, and an outer arm of each arm member forms at least two strap retaining clips.

20. The hanger of claim 13, wherein the arm members each define inner and outer arms, the arms of each arm member defining an open space between at least a portion of the arms.

21. The hanger of claim 13, further comprising a respective garment retainer engaged in an interference fit with each arm member, each garment retainer having a tacky rounded surface to uncreasingly support a shirt at the shoulders thereof.

22. A hanger with a hook and a hook support member depending downwardly from the hook;

first and second arm members extending from the hook support member, each arm member including at least an inner arm and an outer arm connected to the inner arm by at least one connector, the arms defining an open space between at least a portion of the arms;

the hook support member defining at least three edges defining an enclosure;

a cross bar extending between the arm members below the hook support member, an auxiliary enclosure being formed above the cross bar;

the arm members joining each other below the hack support member to define an arm junction located above the auxiliary enclosure and below the hook support member, the arm junction defining an enclosure and plural arcuate strengthening struts each extending downwardly, a first strut being contiguous to a first one of the arm members and a second strut being contiguous to a second one of the arm members.

* * * * *

UNITED STATES PATENT AND TRADEMARK OFFICE

CERTIFICATE OF CORRECTION

PATENT NO. : 7,118,014 B2
APPLICATION NO. : 10/860766
DATED : October 10, 2006
INVENTOR(S) : Ali It is certified that error appears in the above-identified patent and that said Letters Patent is hereby corrected as shown below:

Col. 6, line 35 (claim 22, line 13),
replace “hack” with --hook--.

Signed and Sealed this

Sixth Day of March, 2007

JON W. DUDAS
*Director of the United States Patent and Trademark Office*